United States Patent [19]

Yanazawa et al.

[11] 4,428,217

[45] Jan. 31, 1984

[54] SIDE GUIDES FOR ROLLING STEEL RODS

[75] Inventors: Tadaaki Yanazawa; Teruaki Tanaka, Aoyama; Kazuo; Akio Noda; Takashi Morita, all of Kurashiki, Japan

[73] Assignee: Kawasaki Steel Corporation, Kobe, Japan

[21] Appl. No.: 377,707

[22] Filed: May 13, 1982

[30] Foreign Application Priority Data

Jun. 30, 1981 [JP] Japan ..... 56-101487

[51] Int. Cl.[3] ..... B21B 39/16

[52] U.S. Cl. ..... 72/250; 72/428

[58] Field of Search ..... 72/250, 221, 222, 428

[56] References Cited

U.S. PATENT DOCUMENTS 659,850 10/1900 Jones ..... 72/250

2,184,582 12/1939 Cook ..... 72/250

FOREIGN PATENT DOCUMENTS 2522070 12/1975 Fed. Rep. of Germany ..... 72/250

*Primary Examiner*—Francis S. Husar

*Assistant Examiner*—Jorji M. Griffin

*Attorney, Agent, or Firm*—Balogh, Osann, Kramer, Dvorak, Genova & Traub

[57] ABSTRACT

Side guides for rolling steel rods comprise front and rear rolling guide frames consisting of partitions abuttingly connected to each other in a gap between a pair of rolls having cylindrical surface barrels to form defined rolling zones which are side by side along the roll barrels and divided by the partitions and capable of retaining steel rods being rolled, thereby effectively carrying out rolling of steel rods with grooveless rolls without using calibers without twisting and deforming the steel rods into incorrect cross-sections.

5 Claims, 1 Drawing Figure

SIDE GUIDES FOR ROLLING STEEL RODS

BACKGROUND OF THE INVENTION

1. Field of the Invention

This invention relates to side guides for use in rolling steel rods such as square or circular steel rods.

2. Description of the Prior Art

Caliber rolls have been generally used in rolling elongated metal rods such as square, rectangular or circular cross-sectional rods and wires of steel and non-ferrous materials. The term "steel rod" used in this specification and claims is intended to designate such elongated metal rods of all kinds.

Caliber rolls or rolls whose barrels are formed with calibers for rolling steel rods, however, impose great difficulties in machining the calibers and there is a risk of breaking off due to reduced diameters at calibers, so that the rolls are required to have large initial diameters to avoid the breaking off at the calibers. A great number of caliber rolls of various kinds must be prepared for sizes of rods to be rolled, which require changing of the rolls depending on the sizes of rods and centering adjustments between caliber flanges of a pair of rolls and between the caliber flanges and guides to give rise to extra down time which would be further increased for repairing decayed or damaged calibers due to melting or burning by grinding. In rolling the steel rods by the caliber rolls, moreover, reductions of the materials at corners of the calibers are increased particularly so as to cause larger fishtails on the materials which must be removed from the rods resulting in increased waste materials. Furthermore, resistance to reduction of the material in the calibers is comparatively high which would unavoidably increase the power cost.

In stead of the caliber rolls used in rolling steel rods therefore, the use of caliberless or grooveless rolls having simple cylindrical surfaces without calibers has been proposed and experimentally used in for example alternate horizontal and vertical roll arrangements in order to overcome the above disadvantages. However, such an attempt has not succeeded in practical processes.

The term "grooveless roll" or "caliberless roll" used herein means a roll which is not formed with a caliber or calibers in its barrel.

The invention lies in the discovery in experiments on an actual operation scale that the results of rolling are greatly affected by the fact that there are no holding means for rolled materials in gaps between caliberless rolls. In contrast herewith, caliber flanges of the caliber rolls serve to prevent the steel rods from twisting and overturning or deforming into incorrect (parallelogram) cross-sections, although guides arranged on the entry and exit sides only serve to guide the steel rods into the calibers at locations remote from the calibers. In view of the discovery, the inventors conceived side guides for rolling steel rods capable of retaining steel rods to be rolled through gaps between the caliberless rolls.

SUMMARY OF THE INVENTION

It is an object of the invention to provide side guides for rolling steel rods which effectively eliminate the above disadvantages resulting from caliber rolls by providing defined rolling zones having predetermined widths passing through gaps between the rolls to realize the rolling with the grooveless rolls without twisting and overturning of the steel rods.

In order to achieve this object, the side guides for rolling steel rods according to the invention comprise front and rear rolling guide frames abuttingly combined with each other in a gap between a pair of rolling rolls having cylindrical surface barrels to embrace said pair of rolls on front and rear sides thereof so as to form defined rolling zones which are side by side along said roll barrels and divided by said rolling guide frames.

It is another object of the invention to provide side guides for rolling steel rods, which are ajustable in an axial direction of a pair of rolls to enable all the barrel surfaces of the pair of grooveless rolls to be effectively used as operative rolling surfaces thereby elongating the life of the rolls and simplifying the repairing of the rolls.

It is a further object of the invention to provide side guides for rolling steel rods, which may be easily applied to existing rolling mills, for example, to rest bars for mounting guides for conventional caliber roll mills.

The invention will be more fully understood by referring to the following detailed specification and claims taken in connection with the appended drawings.

DETAILED DESCRIPTION OF THE PREFERRED EMBODIMENT

Figure 1:
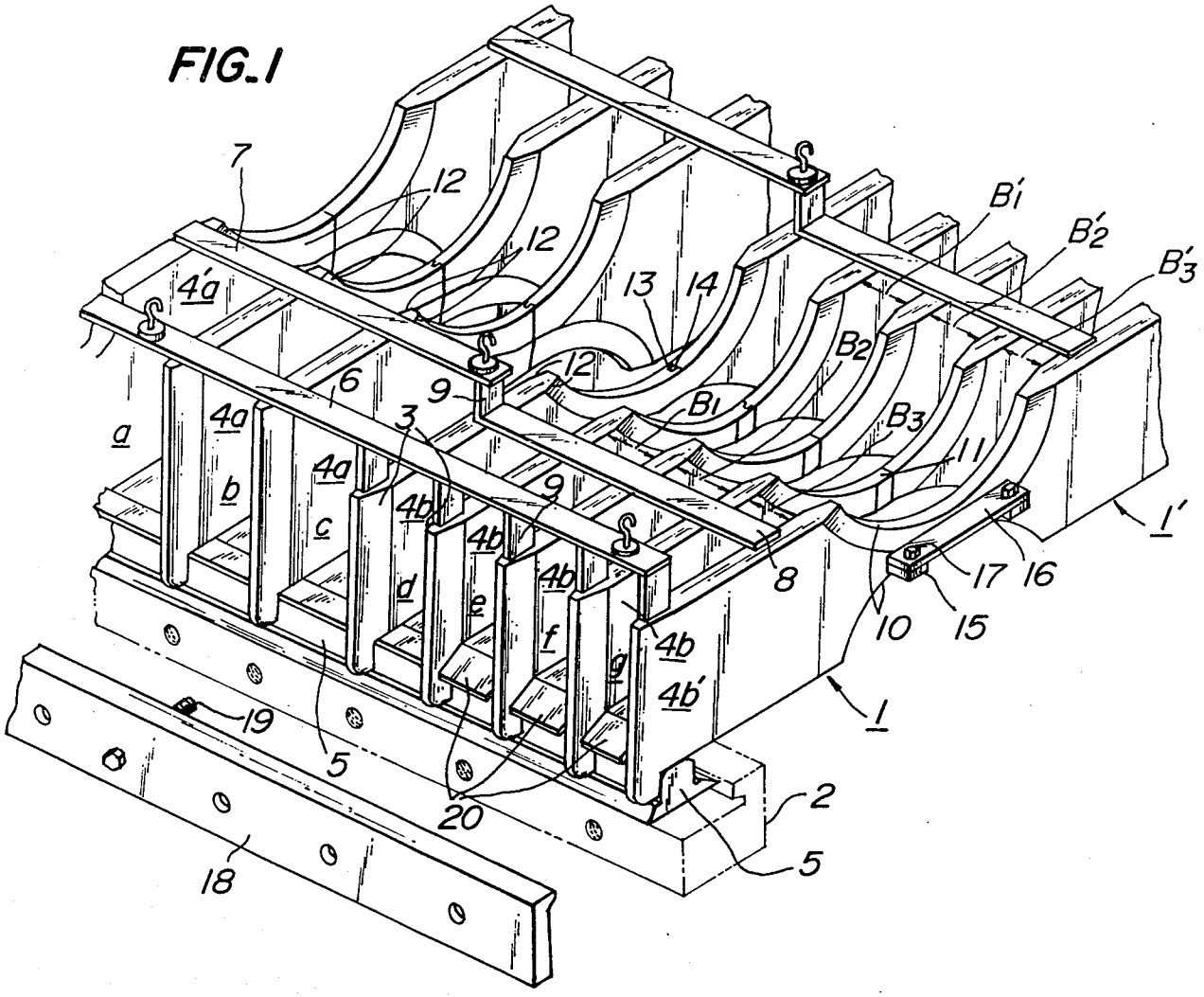
FIG. 1 is a perspective view of a preferred embodiment of side guides according to the invention.

FIG. 1 illustrates one embodiment of the side guides according to the invention applied to a first stage mill for rolling steel rods, such as square rods of the order of 80 mm, 115 mm and 145 mm in width and round rods of the order of 75–85 mm, 90–100 mm and 110 mm in outer diameter rolled from square blooms of 250 mm width. At this first stage mill, the rods are fed alternately in normal and reverse directions by rotating rolls in normal and reverse directions to be subjected to roughing and intermediate rollings and are also continuously fed in the normal direction to be subjected to finishing rolling.

FIG. 1 illustrates a front and rear rolling guide frames 1 and 1' and rest bars 2 (only one shown in the drawing) for supporting the rolling guide frames. As the rolling guide frames 1 and 1' are substantially the same as in constitution, the front rolling guide frame 1 will be mainly explained hereinafter.

The rolling guide frame 1 comprises a plurality of partition plates 4 chamfered at 3 on the sides thereof facing steel rods to be rolled (not shown, at the lower left hand corner in the drawing) for facilitating the introduction of the steel rods between the partition plates 4 and arranged on a base member 5 side by side in parallel with one another with different intervals (for example, progressively narrowed from the left to the right as viewed in the drawing), whose upper ends are held by parallel rail members 6, 7 and 8 welded thereto. In this embodiment, as the partition plates 4 are different in height as shown by suffixed "4*a*" and "4*b*", spacers 9 are arranged welded between the partition plates 4*b* and rail member 6.

At an abutting end of the front and rear rolling guide frames 1 and 1' in a gap between the pair of rolls, the partitions 4 are formed with arc-shaped notches 10 substantially concentric to the respective rolls to avoid any interference with surfaces of the rolls. The notches 10 preferably have a radius somewhat larger than a diameter of rolls at an initial rolling stage and a parallel portion 11 having a length in the rolling direction in the proximity of its abutting end. The partitions 4 are preferably formed along the notches with chamfers 12 concentric thereto except the three partitions particularly at the front guide frame 1 at the right hand in the drawing in order to facilitate introducing rolled materials leaving between the rolls.

It is required that the three distances $B'_1$, $B'_2$ and $B'_3$ are larger than the three distances $B_1$, $B_2$ and $B_3$ between the partitions in order to allow the rolled materials to be widened in a one direction continuous rolling.

As shown in the drawing, the partitions 4*a* and 4*b* arranged on the left side of the third partitions from the rightmost partitions as viewed in the drawing define rolling zones therebetween for the roughing and intermediate rollings and the partitions 4*a* and 4*b* on the sides of the front and rear guide frames are connected at their abutting ends by fitting of vertical grooves 13 and vertical ridges 14 formed therein to enable the partitions to resist traverse pressures transmitted from the rolled materials.

The outermost partitions 4*a*' and 4*b*' are provided with protrusions 15 extending in axial directions of the rolls for connecting the front and rear partitions 4*a*' and 40*b*' at their abutting positions by means of connecting members 16 bolted to the protrusions 15 with bolts 17.

This connection of the front and rear partitions is effected in a condition that the respective guide frames 1 and 1' abut against to each other so as to embrace the pair of rolls and their base members 5 are supported on the rest bars 2. The base member 5 is clamped in any position in the axial direction of the rolls by a restraining plate 18 bolted to the rest bar 2 with bolts 19 to fix the side frames in any adjusted positions. Base guides are arranged between the partitions 4*b* as shown in the drawing.

In one example of rolling, blooms of 250 mm width were rolled through six passes in the defined roughing rolling zones a and three passes in the defined roughing rolling zones b alternately in normal and reverse directions and further rolled through two passes in alternate normal and reverse directions in the defined intermediate rolling zone c and one pass in the reverse direction in the defined intermediate rolling zone d to obtain billets of 170 mm width. Thereafter the billets were rolled progressively in the finishing rolling zones e, f and g in normal directions to obtain billets of 150 mm width which were then passed in succession through tandem finishing rolling mills to obtain required billets.

The rolls had a barrel length of substantially 1,000 mm and an initial outer diameter 650 which was reduced to 410 mm of the minimum diameter by repeatedly machining the barrel for correcting the barrel surface during the use. When caliber rolls have the same initial outer diameter had been used, they were discarded at a barrel diameter of 570 mm. The side guides according to the invention bring uniform wear of a roll and reduce the number of rolls to be maintained, which in conjunction of the effective use of the rolls to the above minimum diameter consequently reduce the initial unit price of rolls to one tenth of that of the prior art. The side guides according to the invention further improve the rate of rolling mill operation by 3–4% because of the reduction of labor for changing and adjusting the rolls and increase the yield rate by approximately 0.5% for the improvement of crop configurations of products.

The defined rolling zones for roughing and intermediate rolling preferably have widths on entry and exit sides at least 10 mm larger than the widths of the material and the defined rolling zones for finishing rolling preferably have widths on entry sides about 10 mm larger and on exit sides about 20 mm than the widths of the material. In this case, the widths of the material are widened by about 30% of the reduction, while in case of caliber rolls those values were about 20%.

The invention achieves the following effects and can carry out the rolling of steel rods effectively without twisting and overturning or deforming the steel rods into incorrect cross-sections.

(1) As the rolls do not have any caliber, they are easily and inexpensively machined.

(2) As the surfaces of the rolls used for rolling are wider, the rolling operation per one roll increases.

(3) As the same rolls are able to be used for rolling products within wide ranges of sizes, the number of rolls to be maintained is less than that of the prior art.

(4) As the rolls are not formed with calibers, the initial outer diameters of the rolls are smaller than those of caliber rolls, with the result that the rolling mill bodies, housings, motors and accompanying installations are small-sized.

(5) There is no risk of breaking because of the grooveless rolls and the life of rolls is longer because they are able to be used to smaller diameters.

(6) It is not necessary to change rolls every time sizes of material to be rolled are changed. Accordingly, the down time is considerably decreased.

(7) It is possible to avoid down time for adjusting centers of upper and lower roll flanges during rolling, for repairing by grinding partially decayed or damaged calibers due to melting or burning, for adjusting centers of the guides and rolls and for others.

(8) The yield rate is improved resulting from the reduction of defects of products such as fishtails.

While the invention has been particularly shown and described with reference to preferred embodiments thereof, it will be understood by those skilled in the art that the foregoing and other changes in form and details can be made therein without departing from the spirit and scope of the invention.

What is claimed is:

1. Side guides for rolling steel rods comprising front and rear rolling guide frames abuttingly combined with each other in a gap between a pair of grooveless rolling rolls having cylindrical surface barrels to embrace said pair of rolls on front and rear sides thereof so as to form defined rolling zones which are side by side in an axial direction of said rolls and divided by said rolling guide frames, said front and rear rolling guide frames being adjustable in the axial direction of said rolls, and the outermost rolling guide frames being provided on outsides of their abutting ends with connecting means.

2. Side guides as set forth in claim 1, wherein fitting connecting means are provided in the abutting ends of partitions of said rolling guide frames forming said defined rolling zones.

3. Side guides as set forth in claim 1, or 2, wherein said defined rolling zones have widths different from one another.

4. Side guides as set forth in claim 1, 2 or 3, wherein substantially half of said defined rolling zones on roughing rolling side and remaining half of said defined rolling zones are different in height.

5. Side guides as set forth in claim 4, wherein said defined rolling zones higher in height are uniform in width on front and rear rolling sides and said defined rolling zones lower in height are wider on the rear rolling sides than on the front rolling sides.

* * * * *